US007513403B2

(12) United States Patent
Fujimoto

(10) Patent No.: US 7,513,403 B2
(45) Date of Patent: Apr. 7, 2009

(54) IDLE DRIVING OPERATION PREVENTING DEVICES FOR FASTENER DRIVING TOOLS, AND FASTENER DRIVING TOOLS HAVING SUCH DEVICES

(75) Inventor: Yasuyuki Fujimoto, Anjo (JP)

(73) Assignee: Makita Corporation, Anjo-shi (JP)

( * ) Notice: Subject to any disclaimer, the term of this patent is extended or adjusted under 35 U.S.C. 154(b) by 0 days.

(21) Appl. No.: 11/633,410

(22) Filed: Dec. 5, 2006

(65) Prior Publication Data

US 2007/0138229 A1 Jun. 21, 2007

(30) Foreign Application Priority Data

Dec. 9, 2005 (JP) ..... 2005-356078

(51) Int. Cl.
*B25F 7/07* (2006.01)
*B25F 7/13* (2006.01)

(52) U.S. Cl. ..... 227/8; 227/119; 227/120; 227/142

(58) Field of Classification Search ..... 227/8, 227/119, 120, 123, 142
See application file for complete search history.

(56) References Cited

U.S. PATENT DOCUMENTS

| | | | | |
|---|---|---|---|---|
| 5,180,091 | A * | 1/1993 | Ota | 227/8 |
| 5,662,257 | A * | 9/1997 | Mukoyama et al. | 227/8 |
| 5,927,585 | A * | 7/1999 | Moorman et al. | 227/132 |
| 6,966,477 | B1 | 11/2005 | Chien-Kuo et al. | |
| 2004/0222266 | A1 * | 11/2004 | Kakuda et al. | 227/8 |

FOREIGN PATENT DOCUMENTS

| | | |
|---|---|---|
| JP | A 9-29663 | 2/1997 |
| JP | A 2005-7546 | 1/2005 |

* cited by examiner

*Primary Examiner*—Rinaldi I. Rada
*Assistant Examiner*—Nathaniel Chukwurah
(74) *Attorney, Agent, or Firm*—Oliff & Berridge, PLC

(57) ABSTRACT

An idle driving operation preventing device (40) includes an engaging member (45) disposed on a pusher (31). The engaging member (45) can engage a stopper member (47) coupled to an operation member (5*a*), so that the movement of the operation member (5*a*) for driving the fastener (n) can be inhibited. The engaging member (45) is biased by a biasing force that is smaller than a biasing force applied to the pusher (31).

9 Claims, 12 Drawing Sheets

IDLE DRIVING OPERATION PREVENTING DEVICES FOR FASTENER DRIVING TOOLS, AND FASTENER DRIVING TOOLS HAVING SUCH DEVICES

This application claims priority to Japanese patent application serial number 2005-356078, the contents of which are incorporated herein by reference.

BACKGROUND OF THE INVENTION

1. Field of the Invention

The present invention relates to devices for preventing idle driving operations of fastener driving tools, and in particular to devices operable to inhibit fasteners, such as nails, from being driven out of a tool body of a driving tool, such as a nailing machine and a pin tacker when all or some the fasteners stored within a magazine have been discharged. The magazine stores the fasteners and serves to feed the fasteners into the tool body one after another. The present invention also relates to fastener driving tools having the devices for preventing the idle driving operations.

2. Description of the Related Art

Known tools for driving thin nails, which arm used for finishing works, have a magazine for storing the nails in a flat plate-like form. Thus, the thin nails are arranged parallel with each other and joined together, while the nails can be separated from each other. The nails in the flat plate-like form are fed from the magazine one after another into a driving channel defined in a tool body as a driving device is operated.

Various improvements have been made to this kind of tools. For example, U.S. Pat. No. 5,180,091 teaches an idle driving operation preventing device that can inhibit the operation of a driving device when all the nags within a magazine have been discharged.

The idle driving operation preventing device of the above patent is schematically shown in FIGS. 13 and 14 and is labeled with reference numeral 50. The conventional device 50 has a switch lever 51 and a stopper member 52 connected to the switch lever 51. The stopper member 52 extends into a magazine 53 in order to intervene in a moving path of a pusher 54. When no remaining nail exists within a fastener storing region 53*a* of the magazine 53 or when no nail has been has been fed into a fastener driving channel 58 of a tool body, an engaging portion 54*a* of the pusher 54 engages an engaging portion 52*a* of the stopper member 52, so that the upward movement of the switch lever 51 for turning on the switch lever 51 is inhibited. Therefore, the idle driving operation of the fasteners by a driver 57 can be prevented. FIG. 14 shows the state where the idle driving operation has been prevented.

However, the conventional idle driving operation preventing device has the following problems. Thus, as shown in FIGS. 13 and 14, the moving direction of the stopper member 52 (vertical direction in FIGS. 13 and 14) is set to be perpendicular to a feeding direction of the nails by the pusher 54 (left direction in FIGS. 13 and 14). In addition, in order to reliably feed the nails in the feeding direction, the nails are biased in the feeding direction by a compression spring 55 that has a relatively strong spring force. On the other hand, the switch lever 51 with the stopper member 52 is biased downward toward an off position by a compression spring 56 that has a spring force smaller than that of the compression spring 55.

Therefore, when the last nail within the magazine 53 has been driven and the pusher 54 has moved further to the left side, the engaging portion 54*a* of the pusher 54 may be pressed against the side surface of the stopper member 52 by the strong force of the compression spring 55 as shown in FIG. 13 prior to achieving the idle driving preventing condition shown in FIG. 14. Because the strong spring force of the compression spring 55 may produce a strong resistance force against the movement of the stopper member 52, a possibility may exist that the switch lever 51 with the stopper member 52 may not move downward toward the off position by the small spring force of the compression spring 56. When this occurs, the idle driving preventing device will not operate.

SUMMARY OF THE INVENTION

It is an object of the present invention to teach an idle driving preventing device that can reliably operate when all or some of fasteners within the magazine have been driven.

In one aspect of the present teachings, idle driving operation preventing devices in fastener driving tools are taught. The idle driving operation preventing devices include an engaging member disposed on a pusher that is biased in a fastener feeding direction by a first biasing force applied by a fast spring. A second spring applies a second biasing force to the engaging member in the fastener feeding direction. The second biasing force is smaller than the first biasing force. A stopper member is mounted to the operation member and movable to enter a moving path in the fastener feeding direction of the pusher, so that the engaging member can engage the stopper member in order to inhibit the movement of an operation member from a first position to a second position for driving the fasteners when all the fasteners within a magazine have driven or when the number of the fasteners within the magazine has been reduced to a predetermined number.

Because the second biasing force applied to the engaging member is smaller than the first biasing force applied to the pusher, a resistance force that may be applied to the stopper member due to contact of the engaging member with the stopper member in the fastener feeding direction can be reduced. As a result, the idle driving operation preventing device can reliably operate.

The timing of engagement of the engaging member with the stopper member may be selectively determined and may be the time when all the fasteners within a magazine have been driven or the time when the number of the fasteners within the magazine has been reduced to a predetermined number. The latter timing ensures that the fastener feeding operation and the fastener driving operation are reliably performed, in particular in the case that very thin fasteners, such as pin nails, are to be stored and driven.

In one embodiment, the engaging member is supported on the pusher, so that the engaging member can move relative to the pusher in the fastener feeding direction and a direction opposite to the fastener feeding direction.

In another embodiment, the stopper member moves in a direction substantially perpendicular to the fastener feeding direction as the operation member moves from the first position to the second position. The operation member may be biased in a direction toward the first position.

In another aspect of the present teachings, fastener driving tools are taught that include a tool body including a fastener driving device operable to drive fasteners, a magazine adapted to store the fasteners and including a fastener feeding device operable to feed the fasteners to the fastener driving device, and an operation member operable to actuate the fastener driving device. A first movable member is movable relative to the magazine in response to the number of the fasteners remaining within the magazine. A second movable member is movable relative to the first movable member and engageable with the operation member for preventing the actuation of the fastener driving device when all or some of the fasteners have been driven by the fastener driving device. Thus, the second movable member serves as an engaging member for engaging the operation member. A biasing device is interposed between the first movable member and the second movable member and biases the second movable member in a direction for engagement with the operation member.

Therefore, when all or some of the fasteners have been driven by the fastener driving device, the second movable member may engage the operation member and prevent the operation member from being operated to drive the fastener driving device. It is possible to adjust the biasing force of the biasing device not to produce a strong resistance force against movement of the operation member when the second movable member does not engage the operation member but contacts therewith.

In one embodiment, the fastener feeding device is a pusher, and the first movable member is a part of the pusher.

In another embodiment, the pusher is forced in the fastener feeding direction by a first spring, and the biasing member is a second spring. Preferably, the biasing force applied to the second movable member by the second spring is smaller than the biasing force applied to pusher by the first spring.

In a further embodiment, the operation member includes an operation switch mounted to the tool body and a stopper member coupled to the operation switch and extending substantially perpendicular to the moving direction of the second movable member. The second movable member is engageable with the stopper member. The stopper member may extend into the magazine and the first and second movable members are disposed within the magazine.

In a still further embodiment, the fastener driving tool further includes a slide door slidably movably mounted to the magazine in the fastener feeding direction and a direction opposite to the fastener feeding direction in order to open and close the magazine. The first spring is interposed between the slide door and the pusher.

In a still further embodiment, the fastener driving further includes a guide member disposed within the magazine and selectively operable to hold the fasteners against an inner wall of the magazine or to restrict the movement of the fasteners in a direction parallel to longitudinal axes of the fasteners in response to the length of the fasteners stored within the magazine.

DETAILED DESCRIPTION OF THE INVENTION

Each of the additional features and teachings disclosed above and below may be utilized separately or in conjunction with other feature and teachings to provide improved idle driving operation preventing devices and fastener driving tools incorporating such devices. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Figure 1:
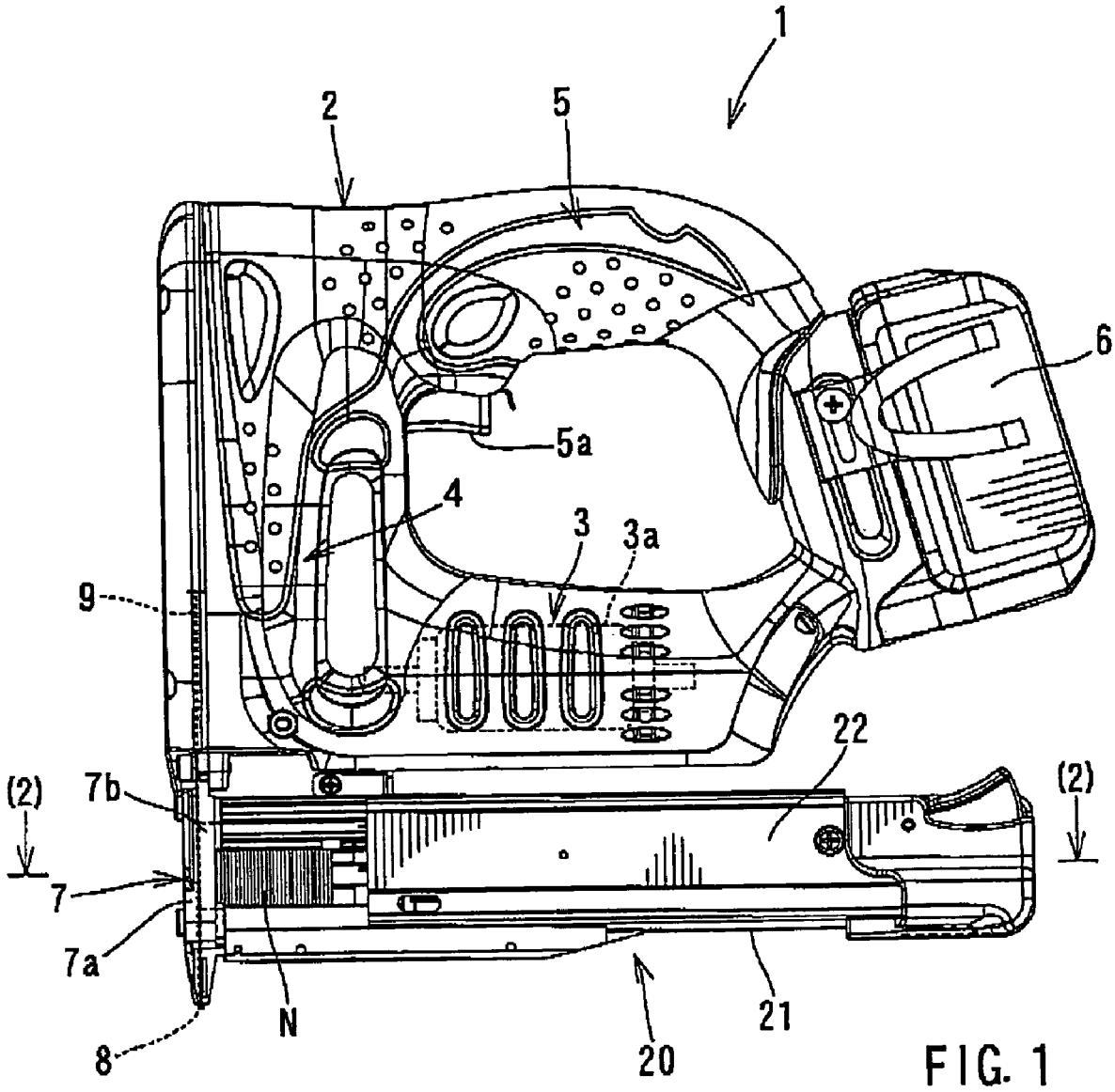
FIG. 1 is a side view of a fastener driving tool with a magazine incorporating an idle driving operation preventing device according to a representative embodiment of the present invention.

An embodiment of the present invention will now be described with reference to FIGS. 1 to 12, which show a fastener driving tool 1 embodied as a pin tacker having an electric motor as a drive source. As shown in FIG. 1, the fastener driving tool 1 generally includes a tool body 2 and a magazine 20.

The tool body 2 includes a drive section 3 having an electric motor 3*a* disposed therein, a motion converting section 4 having a motion converting mechanism disposed therein for converting the rotation of the motor 3*a* into a reciprocating movement of a driver 9, and a handle section 5 adapted to be grasped by an operator. A rechargeable battery 6 for supplying a power to the motor 3*a* is mounted to an intermediate section disposed between the drive section 3 and the handle section 5.

A driver guide 7 extends downward from the lower portion of the motion converting section 4. The driver guide 7 includes a first guide plate 7*a* and a second guide plate 7*b* that are lapped with each other and thereafter joined together. A fastener driving channel 8 is defined between the first and second guide plates 7*a* and 7*b*, so that the driver 9 can reciprocate within the fastener driving channel 8 in order to drive fasteners The driver 9 has a flat plate-like configuration and is elongated in a vertical direction. The driver 9 is coupled to the motion converting mechanism, so that the driver 9 vertically reciprocates within the driving channel 8. As the driver 9 moves downward, the driver 9 applies an impact on the upper end of the frontmost nail n0 (leftmost one in FIG. 5) among nails n (see FIGS. 3 and 5) supplied into the driving channel 8, so that the frontmost nail n0 is driven out of the lower opening of the driver guide 7.

Figure 12:
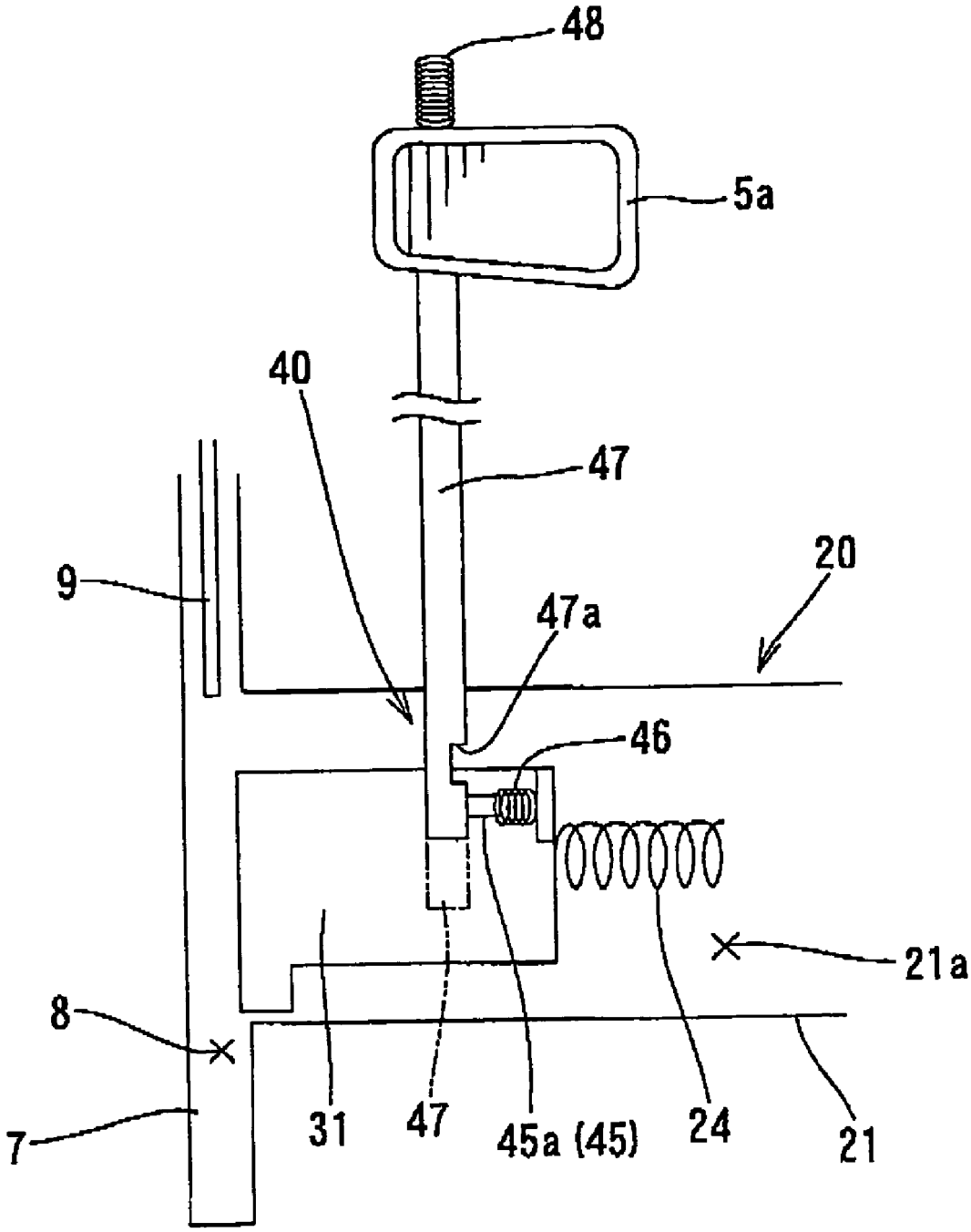
FIG. 12 is a schematic side view of the idle driving operation preventing device.

An operation member 5*a* configured as switch lever or a trigger is mounted to the lower portion of the handle section 5. The operation member 5*a* is electrically coupled to the motor 3*a*, so that the motor 3*a* is started when the operator grasps the handle section 5 and pulls the operation member 5*a* with his or her fingers. As shown in FIG. 12, a stopper member 47 is connected to the operation member 5*a* and serves as a component of an idle operation preventing device 40 as will be explained later. The stopper member 47 may be formed integrally with the operation member 5*a*.

FIGS. 2 to 9 show the details of the magazine 20. The magazine 20 is attached to the driver guide 7 and generally includes a magazine body 21 and a slide door 22 operable to open and close the magazine body 21. The magazine body 21 has a substantially flat plate-like configuration. Also, the slide door 22 has a substantially flat plate-like configuration. One end (the front end with respect to the feeding direction of the nails n, i.e., on the left end as viewed in FIG. 2) of the magazine body 21 is secured to the backside face of the guide plate 7*b* of the driver guide 7. A fastener storing region 21*a* for storing the nails n is defined within the magazine body 21 in a position on the upper side as viewed in FIG. 3 and communicates with the fastener driving channel 8 of the driver guide 7. In this embodiment, the nails n are arranged in parallel to each other and joined together to form a flat plate-like configuration. The nails n thus joined together will be hereinafter collectively called as "stick nail N." The magazine 20 may be configured to be able to store various types of stick nails N that are different in the size of their nails n. In this embodiment, the magazine 20 can store four types of stick nails N respectively consisting of nails n having a length of 35 mm, nails n having a length of 30 mm, nails n having a length of 25 mm and nails n having a length of 18 mm. In this specification, the term "fastener feeding direction" is used to mean a direction for feeding the stick nail N toward the fastener driving channel 8.

As schematically shown in FIG. 12, a pusher 31 is disposed within the fastener storing region 21*a* and proximally to the bottom of the fastener storing region 21*a*. The pusher 31 is biased in the fastener feeding direction by a compression spring 24 (a compression coil spring in this embodiment). Therefore, the pusher 31 forces the stick nail N toward the fastener feeling direction, so that the nails n are supplied one after another into the fastener driving channel 8 of the driver guide 7 as the frontmost nail n0 is driven out of the driver guide 7. In this embodiment, the compression spring 24 is disposed between the pusher 31 and the slide door 22. Therefore, the biasing force of the compression spring 24 is not applied to the pusher 31 when the slide door 22 is opened, although the biasing force of the compression spring 24 is applied to the pusher 31 when the slide door 22 is closed. Therefore, the operation for charging the stick nail N into the fastener storing region 21*a* and the operation for removing the stick nail N from the fastener storing region 21*a* can be easily made by opening the slide door 22. The end portion in the fastener feeding direction of the fastener storing region 21*a* is open into the fastener driving channel 8 of the driver guide 7.

The slide door 22 is slidably mounted on the magazine body 21, so that the operator can move the slide door 22 in the fastener feeding direction and a direction opposite to the fastener feeding direction relative to the magazine body 21 in order to close and open the magazine body 21. A guide member 25 having an elongated flat plate-like configuration is movably supported on the inner side of the slide door 22, so that the guide member 25 can move in the fastener feeding direction (leftward as viewed in FIG. 2), the direction opposite to the fastener feeding direction (rightward as viewed in FIG. 2) and a direction of thickness of the stick nail N (vertical direction as viewed in FIG. 2) relative to the slide door 22.

Figure 4:
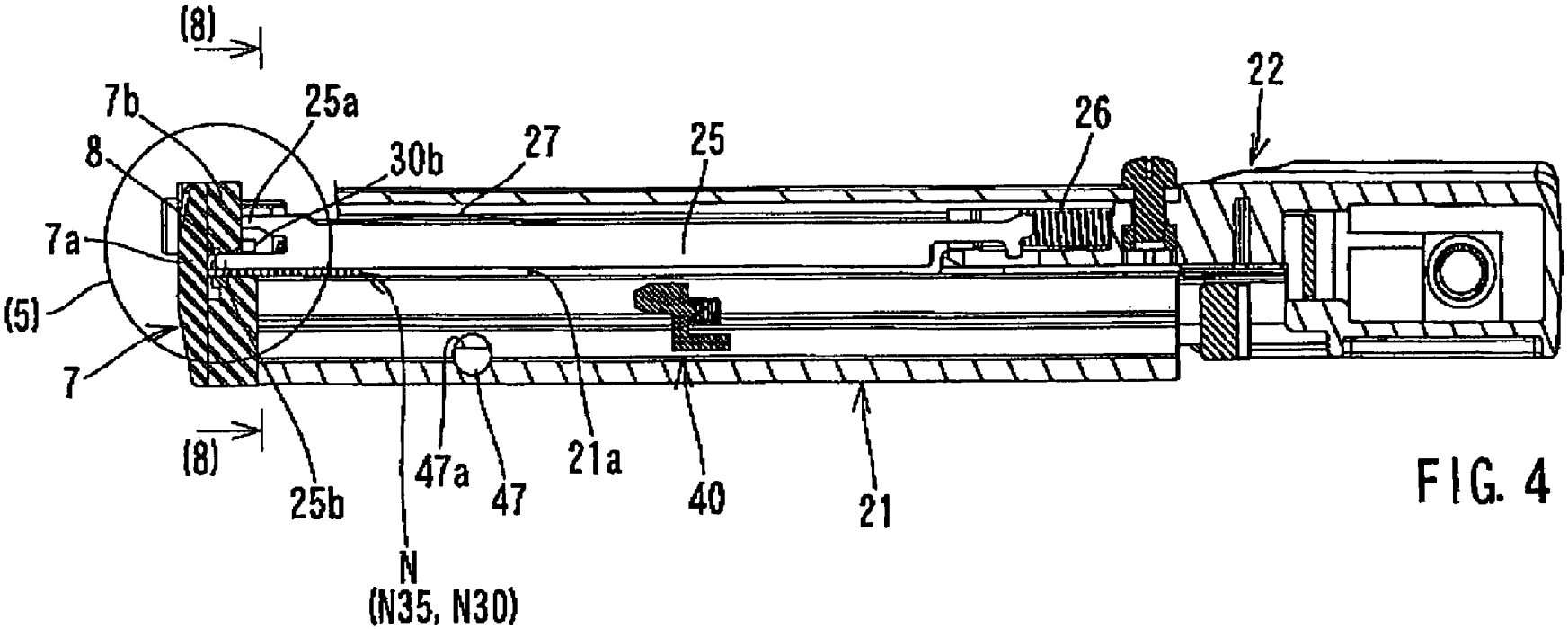
FIG. 4 is cross sectional view similar to FIG. 2 but showing the magazine in the closed state and showing relatively long stick nail N (N35 or N30) stored within the magazine.

As shown in FIG. 4, a compression spring 26 is interposed between the rear end of the guide member 25 and a portion of the slide door 22 opposing to the rear end of the guide member 25, so that the guide member 25 is biased by the compression spring 26 in the fastener feeding direction. A leaf spring 27 is interposed between the front portion of the guide member 25 and the inner face of the slide door 22, so that the front portion of the guide member 25 is biased toward the stick nail N in the direction of thickness thereof (downward as viewed in FIG. 2). Therefore, primarily the front portion of the guide member 25 may be pressed against the stick nail N.

Figure 3:
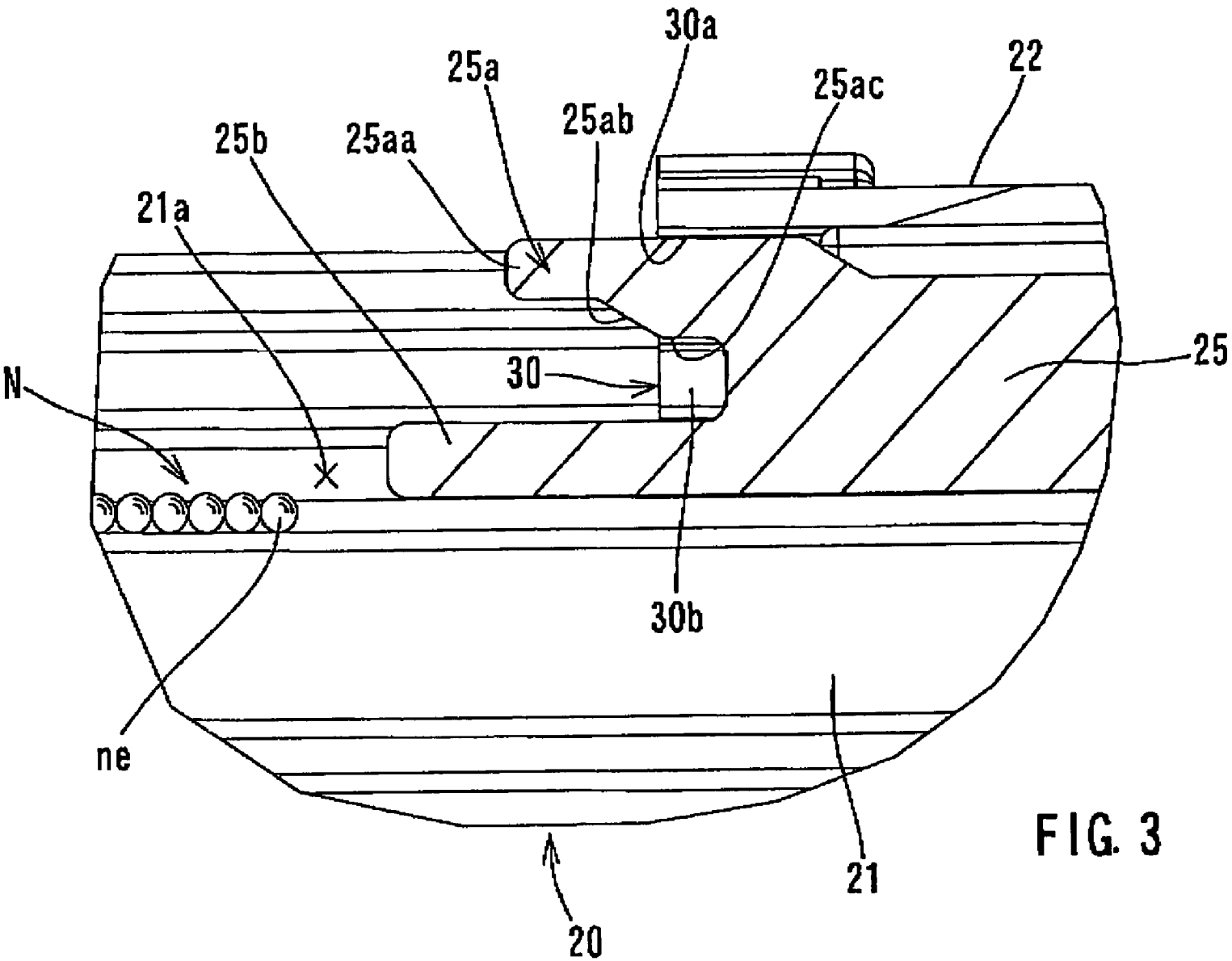
FIG. 3 is an enlarged view of a region surrounded by circle (3) in FIG. 2 and showing a front portion of a guide member and its associated parts.

As shown in FIG. 3, a first control arm 25*a* and a second control arm 25*b* having different lengths from each other extend in the fastener feeding direction from the front end of the guide member 25. More specifically, the first control arm 25*a* is positioned on the upper side as viewed in FIG. 3 and is shorter than the second control arm 25*b*, which is positioned on the lower side of the first control arm 25*a* as viewed in FIG. 3. As the slide door 22 is closed, the first control arm 25*a* abuts to the backside face of the plate 7*b* of the driver guide 7, and the second control arm 25*b* protrudes into the fastener driving channel 8 as shown in FIGS. 4 to 7.

The first control arm 25*a* has a width in the direction of thickness of the stick nail N (vertical direction as viewed in FIGS. 2 and 7) and includes a narrow width portion 25*aa*, a broad width portion 25*ac* and a transient portion between the narrow width portion 25*aa* and the broad width portion 25*ac*. The narrow width portion 25*aa* is positioned on the front side and the broad width portion 25*ac* is positioned on the rear side with respect to the fastener feeding direction. A guide surface 25*ab* is formed on the transient portion on the side opposing to the stick nail N and is inclined such that the guide surface 25*ab* becomes further away from the stick nail N in the fastener feeding direction. Thus, the width of the first control arm 25*a* becomes smaller in the fastener feeding direction.

The narrow width portion 25*aa* and the broad width portion 25*ac* are respectively positioned on the front side and the rear side of the first control arm 25*a*, so that the width of the first control arm 25*a* deceases toward the front side.

Figure 9:
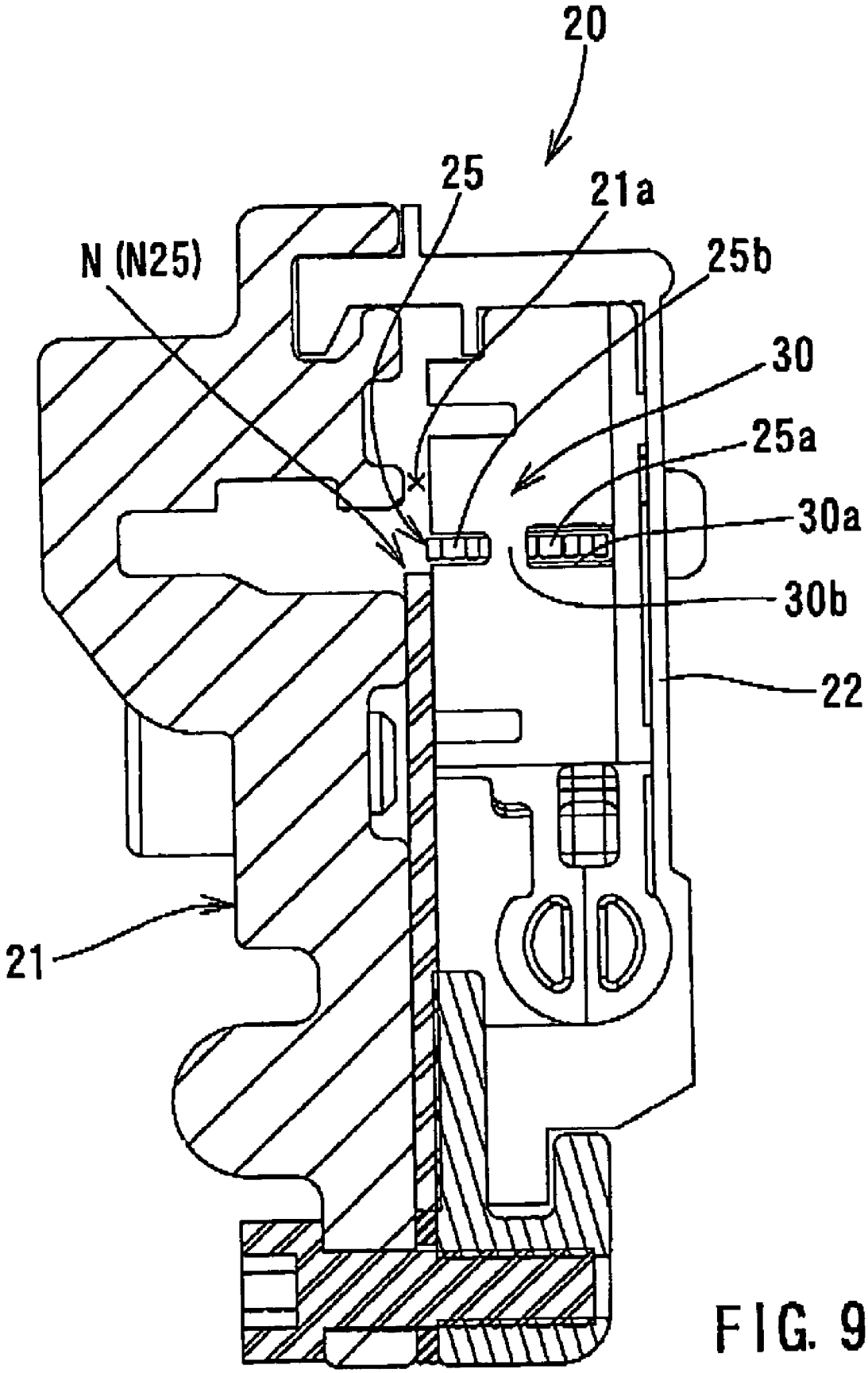
FIG. 9 is a vertical sectional view of the magazine and showing the stick nail having a length of 25 mm stored within the magazine.
Figure 10:
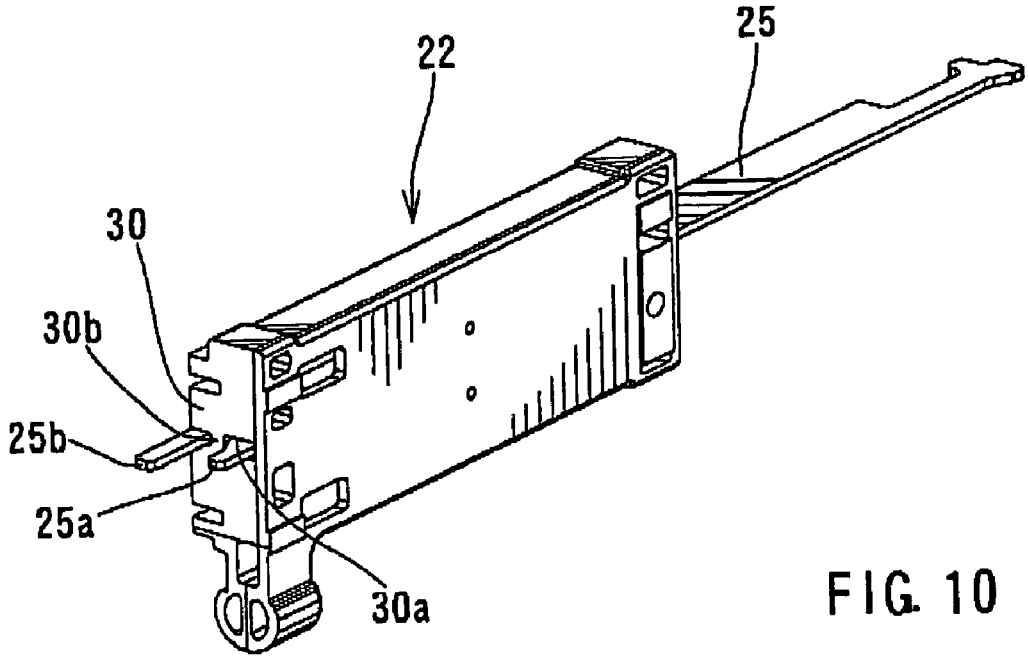
FIG. 10 is a perspective view of the slide door as viewed from the outer side with respect to a fastener storing region.
Figure 11:
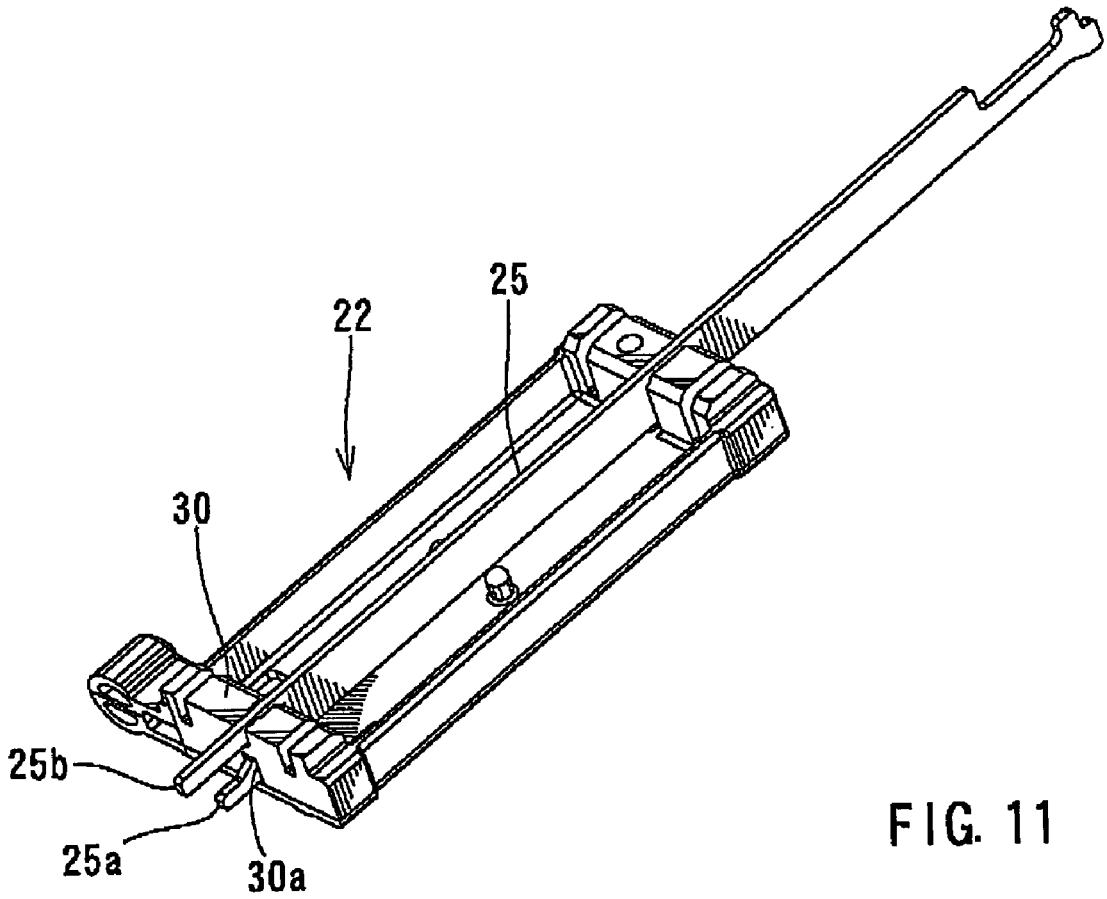
FIG. 11 is a perspective view of the slide door as viewed from the inner side with respect to the fastener storing region.

As shown in FIGS. 9 to 11, a guide control member 30 is attached to the front portion (with respect to the fastener feeding direction) of the slide door 22. A rectangular retainer slot 30*a* is formed in the guide control member 30 throughout the thickness thereof. The first control arm 30*a* extends forward through the retainer slot 30*a*. Because the guide member 25 is biased toward the stick nail N by the leaf spring 27, the first control arm 25*a* is pressed against an engaging part 30*b* defining an edge of the retainer slot 30*a* of the guide control member 30 opposing to the first control arm 25*a*.

Figure 2:
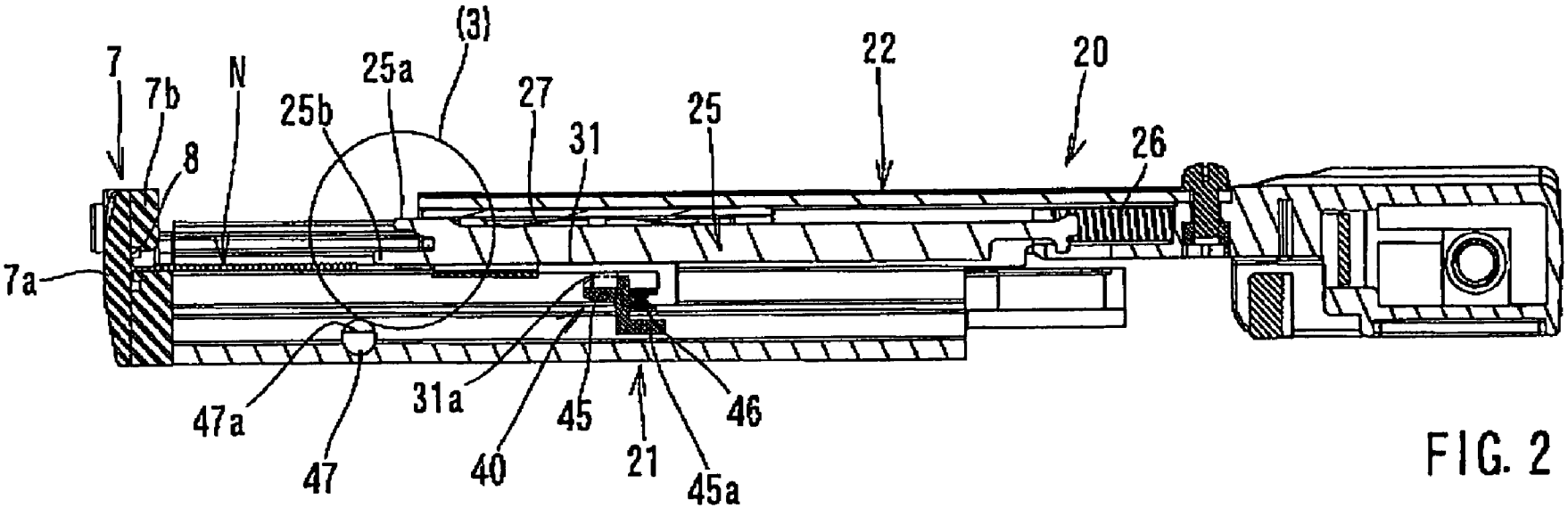
FIG. 2 is an enlarged cross sectional view taken along line (2)-(2) in FIG. 1 and showing a slide door in an open position.

As shown in FIGS. 2 and 3, as the slide door 22 moves from the fully closed position to the fully open position, the first control arm 25*a* of the guide member 25 protrudes forwardly from the retainer slot 30*a* due to the biasing force in the fastener feeding direction of the compression spring 26, and the broad width portion 25*ac* is brought to rest on the engaging part 30*b* of the guide control member 30. Therefore, primarily the front portion of the guide member 25 shifts upward as viewed in FIGS. 2 and 3 away from the stick nail N against the biasing force of the leaf spring 27.

Figure 6:
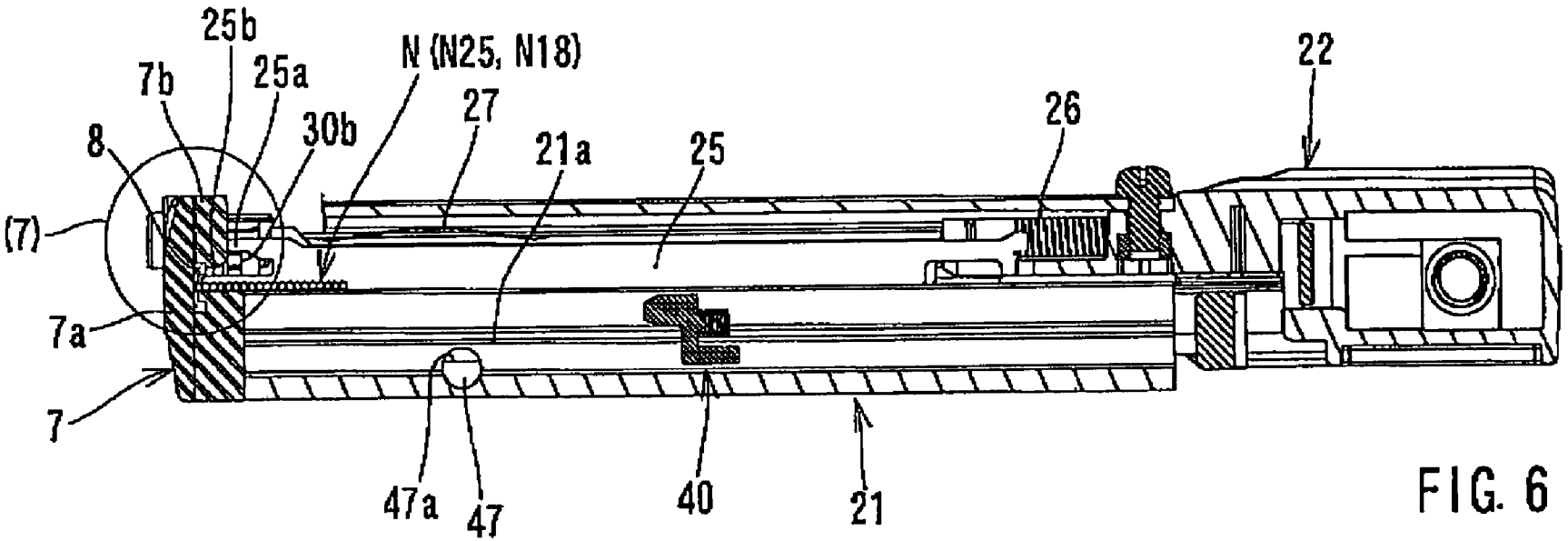
FIG. 6 is cross sectional view similar to FIG. 4 but showing relatively short stick nail N (N25 or N18) stored within the magazine.
Figure 7:
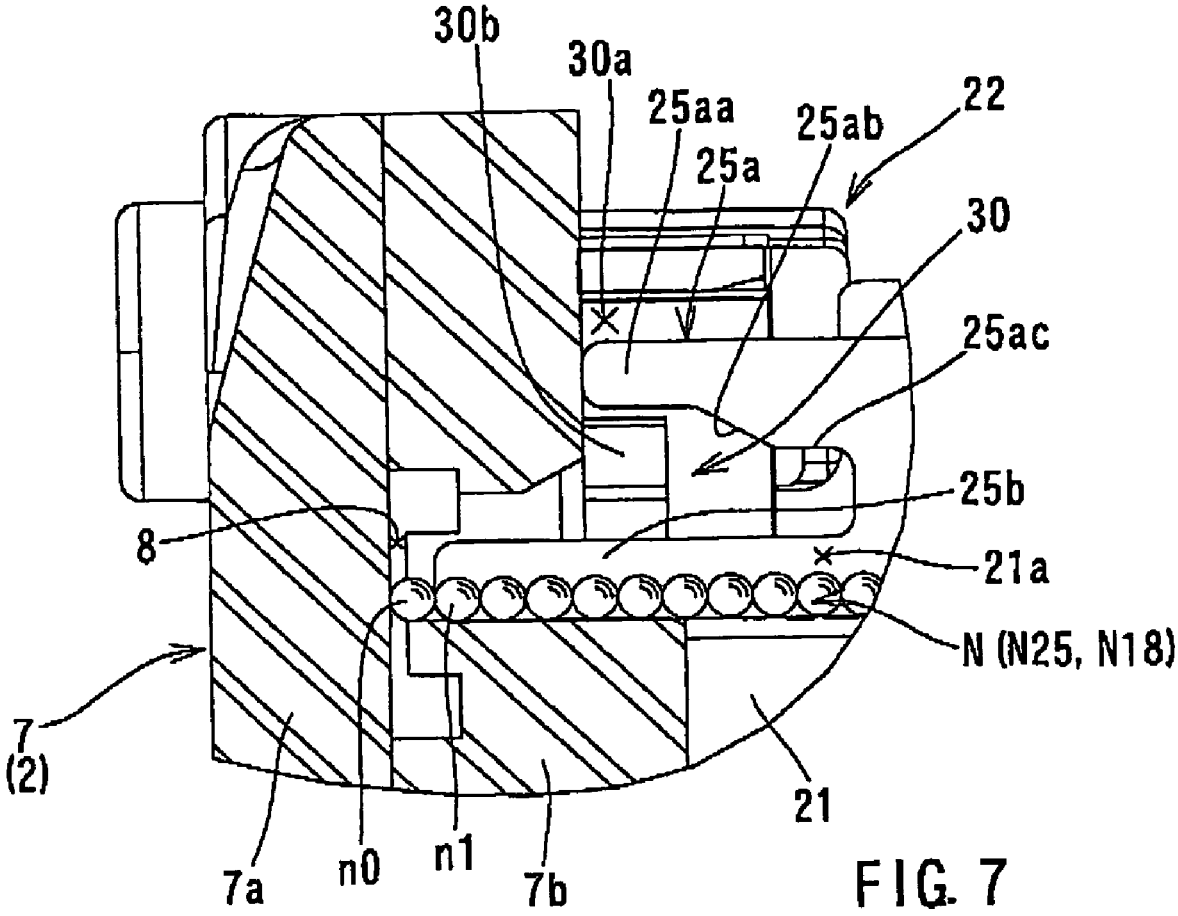
FIG. 7 is an enlarged view of a region surrounded by circle (7) in FIG. 6 and showing the front portion of the guide member and its associated parts.

On the contrary, as shown in FIGS. 6 and 7, as the slide door 22 moves from the fully open position to the fully closed position, the first control arm 25*a* of the guide member 25 abuts to the backside face of the plate 7*b* of the driver guide and moves rearward relative to the guide control member 30 against the biasing force of the compression spring 26, so that the narrow width portion 25*aa* is rest on the engaging part 30*b* of the guide control member 30. Therefore, the guide member 25 shifts toward the stick nail N by a distance corresponding to the difference in width between the narrow width portion 25*aa* and the broad width portion 25*ac* from the position shown in FIGS. 2 and 3.

Therefore, if the stick nail N is that having a relatively short length (such as stick nails N25 and N18 that will be described later), the guide member 25 is positioned away from the heads of the nails in the stick nail N but is positioned at a first restricting position where the guide member 25 substantially contacts the side wall of the fastener storing region 21*a*. In the first restricting position, the guide member 25 can restrict the movement of the stick nail N in the direction parallel to the axes of the nails n (see FIGS. 6 and 7).

Figure 5:
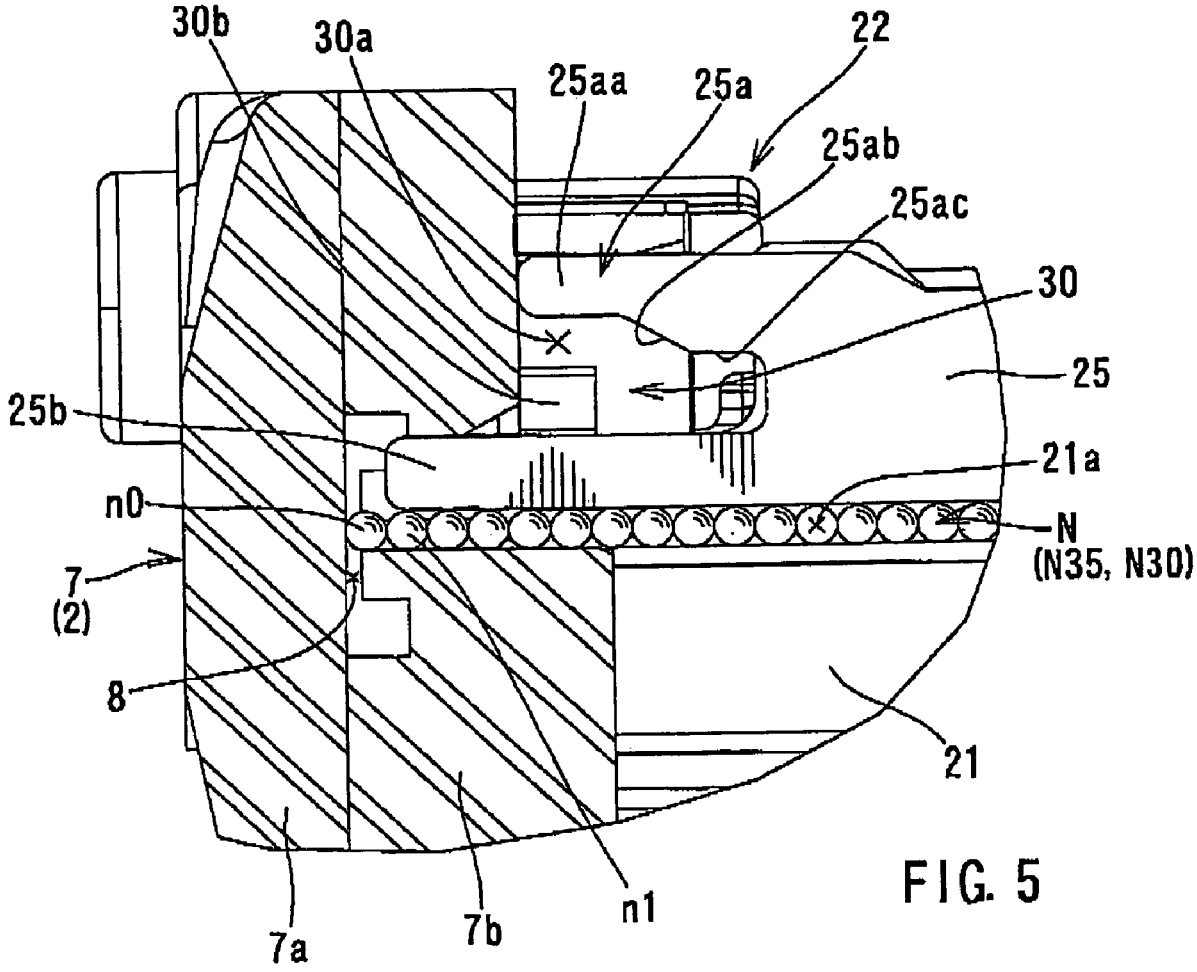
FIG. 5 is an enlarged view of a region surrounded by circle (5) in FIG. 4 and showing the front portion of the guide member and its associated parts.

If the stick nail N is that having a relatively long length (such as stick nails N35 and N30 that will be described later), the guide member 25 is positioned at a second restricting position where the guide member 25 is resiliently pressed against shanks of the nails in the stick nail N as shown in FIGS. 4 and 5. Therefore, the guide member 25 prevents the stick nail N from moving (floating) away from the side wall of the fastener storing region 21*a* in the direction of thickness of the stick nail N.

Figure 8:
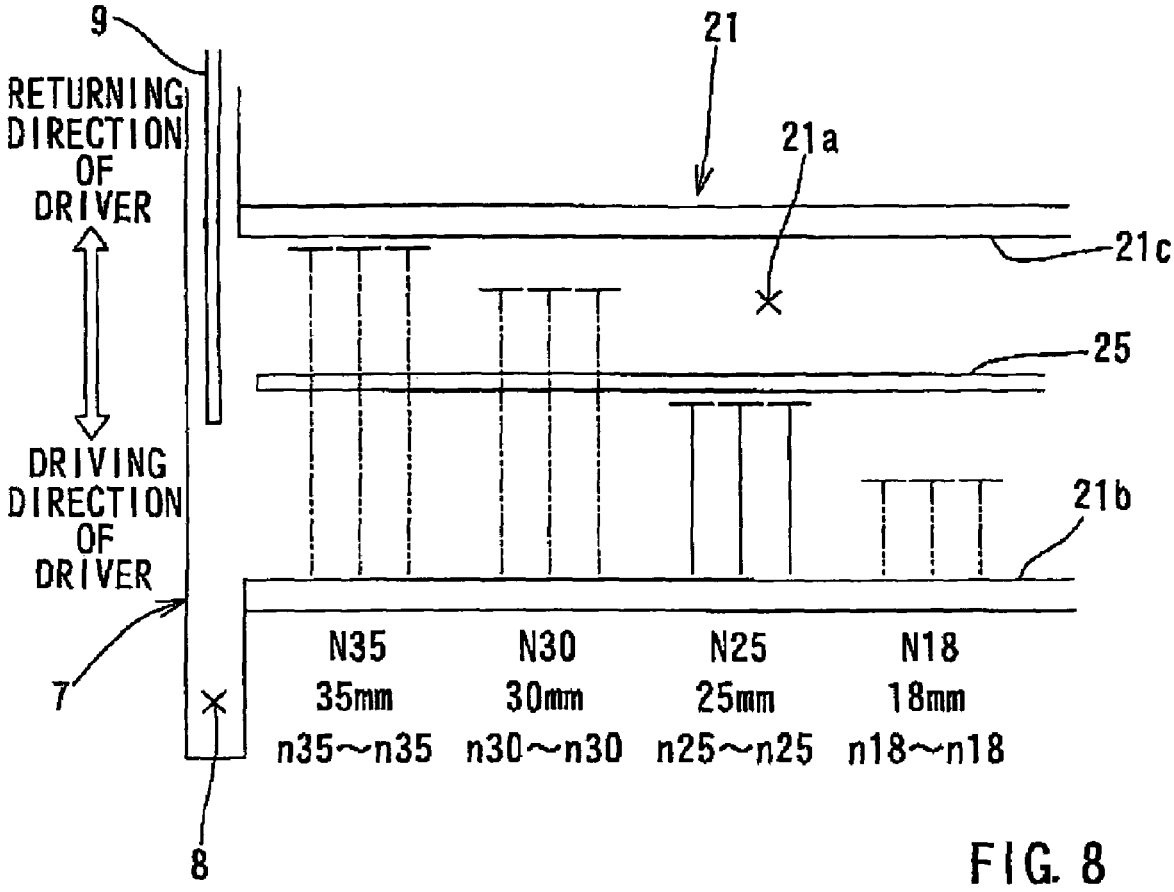
FIG. 8 is a schematic view of the magazine and its associated parts and showing the relation between the guide member and four types of stick nails having different lengths.

FIG. 8 schematically shows the state where four different stick nails N35, N30, N25 and N18, which are different in the lengths of the nails n, are stored within the fastener storing region 21*a* within the magazine body 21. Of course, these four different stick nails will not be stored at one time in the actual operation.

In FIG. 8, the stick nails N35, N30, N25 and N18 are arranged in this order starting from the left. The stick nail N 35 consists of nails n35 having a length of 35 mm, the stick nail N30 consists of nails n30 having a length of 30 mm, the stick nail N25 consists of nails n25 having a length of 25 mm, and the stick nail N18 consists of nails n18 having a length of 18 mm. In this specification, one end of the stick nail, where the heads of the nails are positioned, will be called as "head" of the stick nail, and the other end of the stick nail, where the tip ends of the shanks of the nails are positioned, will be called as "tail" of the stick nail. In addition, in this specification, "length" of the stick nail is used to mean the length in a direction parallel to the axes of The nails.

The stick nails N35, N30, N25 and N18 are stored within the fastener storing region 21*a* with their tails aligned with each other along a bottom wall 21*b* of the fastener storing region 21*a*. Therefore, the heads of the stick nails N 35, N30, N25 and N18 are spaced from a top wall 21*c* of the fastener storing region 21*a* by different distances from each other.

As shown in FIG. 8, the head of the stick nail N35 having the longest length is spaced from the top wall 21*a* by a very small distance, so that no substantial clearance exists between the head of the stick nail N35 and the top wall 21*a*. Therefore, the movement of the stick nail N35 in the vertical direction or the direction of the length of the stick nail N35 is restricted by the bottom wall 21*b* aid the top wall 21*c*. The head of the stick nail N30 is spaced from the top wall 21*a* by a small distance. The head of the stick nail N25 is positioned at substantially the middle position between the top wall 21*c* and the bottom wall 21*b*, so that the head of the stick nail N25 is spaced from the top wall 21*c* by a distance substantially equal to the length of the stick nail N25. The head of the stick nail N18 is spaced by a large distance from the top wall 21*c*.

As the driver 9 moves downward within the fastener driving channel 8, the frontmost nail n0 is driven out of the fastener driving channel 8 or the driver guide 7. Then, the driver 9 moves upward and the nail n1 next to the nail n0 (see FIG. 5) is supplied into the fastener driving channel 8. If the upwardly moving driver 9 has contacted with the nail n1, a force will be applied to that nail to move the same upward.

In the case of the stick nail N35, no substantial upward movement of the nail n35 corresponding to the nail n1 will occur, because the head of the stick nail N35 is positioned proximally to the upper wall 21*c*. Therefore, it is possible to supply the nails n35 of the stick nail N35 with the nails n35 properly positioned.

In the case of the stick nail N30, there is a possibility that the upward movement of the nail n30 corresponding to the nail n1 will occur. However, the distance between the head of the stick nail N30 and the upper wall 21*c* is small, it is still possible to supply the nails n35 of the stick nail N35 with the nails n35 properly positioned.

In the case of the stick nail N25, there is a possibility that the upward movement of the nail n25 corresponding to the nail n1 will occur up to a distance substantially corresponding to the length of the stick nail N25 (i.e., about 25 mm). In particular, in case that the nail n25 is the last one or the rearmost one (corresponding to the rearmost nail ne shown in FIG. 3) and the last nail has been largely shifted in the vertical direction (i.e., the direction of the length of the stick nail N25), it is difficult to properly feed the last nail into the fastener driving channel 8. To this end, the guide member 25 serves to restrict the movement of the stick nail N25 in the vertical direction. More specifically, the guide member 25 is mounted to the inner face of the slide door 22 such that the guide member 25 is positioned to extend proximally to and along the upper side of the head of the stick nail N25 when the slide door 22 has been closed.

Also in the case of the stick nail N18, there is a possibility that the upward movement of the nail n18 corresponding to the nail n1 will occur. However, the distance between the head of the stick nail N18 and the guide member 25 is sell, it is still possible to supply the nails n18 of the stick nail N18 with the nails n18 properly positioned.

In this way, the upward movement of the stick nails N35 and N30 are restricted by the top wall 21*c*, and the upward movement of the stick nails N25 and N18 is restricted by the guide member 25. Therefore, for all the stick nails N35, N30, N25 and N18, it is possible to supply the last nail into the fastener driving channel 8 with the last nail properly positioned.

As described previously, the guide member 25 mounted to the slide door 22 is positioned at substantially the middle position (with respect to the vertical direction, i.e., the direction along the length of the stick nail N) of the fastener storing region 21*a*. Therefore, the guide member 25 also serves to prevent the stick nails N35 and N30 from moving (floating) in the direction of thickness of each of the stick nails N35 and N30 as discussed in connection with FIGS. 4 and 5.

In this way, depending on the length of the stick nail N, the guide member 25 selectively serves to restrict the movement of the stick nail N in the direction of its length (axial movement restricting function) or to prevent the movement of the stick nail N in the direction of thickness of the stick nail N or the direction perpendicular to the feeding direction (transverse movement restricting function).

As described previously, as the slide door 22 is moved to open, the guide member 25 moves forwardly in the feeding direction due to the biasing force of the compression spring 26. More specifically, as the guide member 25 movers forwardly, the transition of state occurs from the state where the narrow width portion 25*aa* of the first control arm 25*a* is rest on or engages the engaging part 30*b* of the guide control member 30 to the state where the broad width portion 25*ac* is rest on or engages the engaging part 30*b*. This transition can be smoothly performed by virtue of the presence of the guide surface 25*ab* that is positioned between the narrow width portion 25*aa* and the broad width portion 25*ac* and is inclined in the direction of the width of the guide member 25 or in the transverse direction. Therefore, primarily the front portion of the guide member 25 moves transversely away from the stick nail N against the biasing force of the compression spring 27, so that the front portion of the guide member 25 is held to be spaced from the side wall of the fastener storing region 21*a* as shown in FIGS. 2 and 3.

As described above, the front portion of the guide member 25 is held to be spaced from the side wall of the fastener storing region 21*a* when the slide door 22 is opened. Therefore, when the slide door 22 is moved from the fully open position to the filly closed position, the front portion of the guide member 25 does not abut to or does not substantially interfere with the stick nail N stored within the fastener storing region 21*a*. As a result the slide door 22 can be smoothly closed without causing substantial interference or without being caught by the rear end (the rearmost nail ne) of the stick nail N.

Further, the second control arm 25*b* extends in the fastener feeding direction from the front end of the control member 25 beyond the first control arm 25*a*. As shown in FIG. 5, when the slide door 22 is closed, the front end of the second control arm 25*b* extends into the plate 7*b* of the driver guide 7. In the case that the stick nail N is that having a relatively long length, such as the stick nail N35 or N30, the side surface of the second control arm 25*b* opposing to the side wall of the fastener storing region 21*a* serves to press the stick nail N against the side wall of the fastener storing region 21*a*. As shown in FIG. 5, the front end of the second control arm 25*b* is positioned to hold the stick nail N up to the nail n1 positioned next to the frontmost nail n0 of the stick nail N. Therefore, it is possible to reliably prevent the stick nail N from moving in the transverse direction. On the other hand, in the case of the stick nail N having a relatively short length, such as the stick nail N25 and N18, the front end of the second control arm 25*b* is positioned to vertically oppose to the head of the stick nail N up to the nail n1. Therefore, it is possible to reliably prevent the stick nail N from moving in the vertical direction.

As described above, regardless of the type of the stick nail N, either the vertical movement or the transverse movement of the nail n can be restricted Therefore, it is possible to properly position each nail n as it is supplied into the fastener driving channel 8 even if the nail n to be supplied is the rearmost nail ne. As a result, it is possible to reliably perform the driving operation regardless of the type of the stick nail N.

The idle driving preventing device 40 according to the representative embodiment will now be described. The device 40 serves to inhibit the operation (pulling operation in this representative embodiment) of the operation member 5*a* and to eventually prevent the driving operation of the nails n when no nail exists within the fastener storing region 21*a* of the magazine 20 after the rearmost nail ne (last nail) has been driven out of the fastener driving channel 8. Therefore, the driver 9 will not directly strike a workpiece, into which nails n are to be driven, so that a potential damage on the workpiece can be avoided.

The idle driving preventing device 40 is best shown in FIG. 12. As described previously, the stick nail N stored within the fastener storing region 21*a* is farce in the fastener feeding direction by the pusher 31. The pusher 31 is disposed within the fastener storing region 21*a* and is movable in the fastener feeding direction and the direction opposite to the fastener feeding direction. The compression spring 24 has a relatively strong spring force and biases the pusher 31 in the feeding direction.

As the nails n in the stick nail N are driven one after another, the stick nail N moves in the fastener feeding direction by the pressing force applied by the pusher 31. As the driver 9 moves upward after moving downward to drive the rearmost nail ne or the last nail supplied into the fastener driving channel 8, the pusher 31 reaches a frontmost position (hereinafter also called "idle driving preventing position") with respect to the fastener feeding direction. This state is shown in FIG. 12. In the idle driving preventing position, the frontmost end of the pusher 31 protrudes into the fastener driving channel 8.

Figure 13:
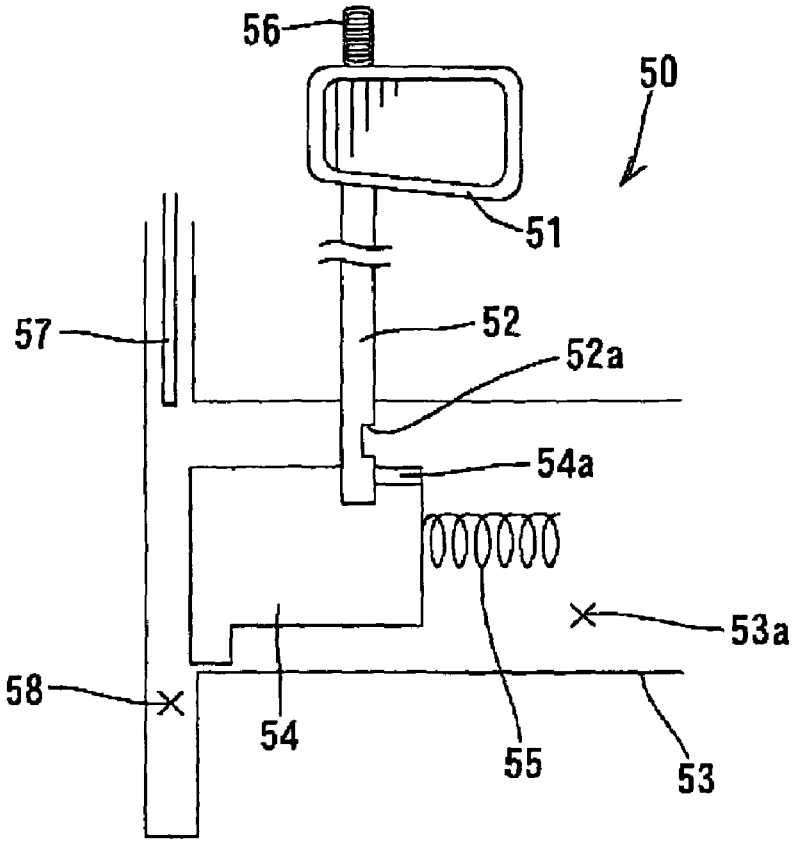
FIG. 13 PRIOR ART
FIG. 13 is a schematic view of a conventional idle driving operation preventing device and showing the state where an engaging portion on the side of a pusher abuts to the rear side of a stopper member.
Figure 14:
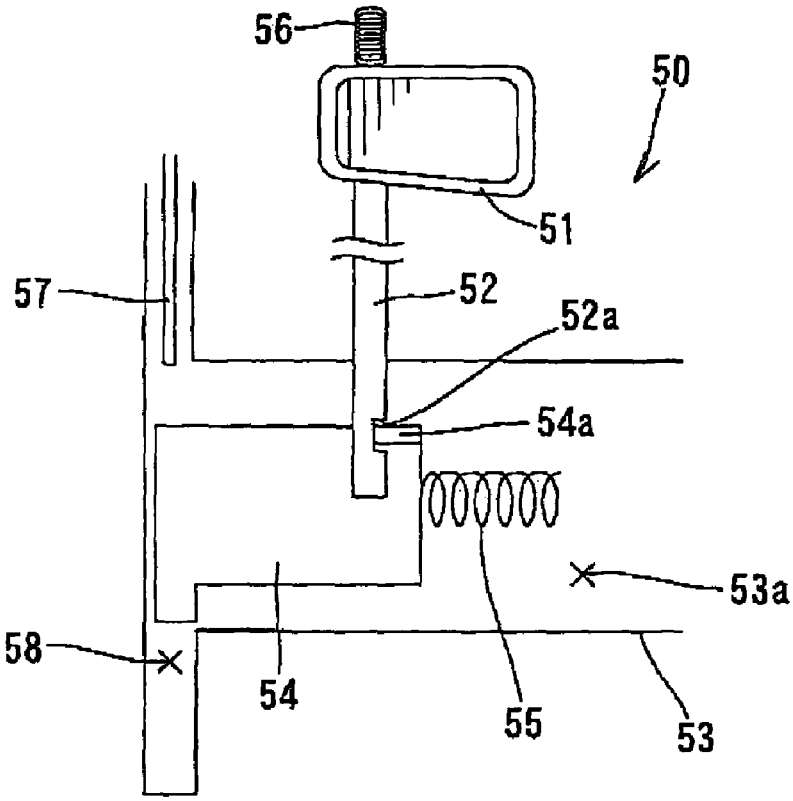
FIG. 14 PRIOR ART
FIG. 14 is a schematic view similar to FIG. 13 but showing the state where the engaging portion on the side of the pusher engages the engaging portion of the stopper member.

An engaging member 45 is disposed on one lateral side (lower side as viewed in FIGS. 2, 4 and 6) of the pusher 31. The engaging member 45 is supported by a support wall portion 31*a* formed on the one lateral side of the pusher 31 such that the engaging member 45 can move relative to the pusher 31 both in the fastener feeding direction and in the direction opposite to the fastener feeding direction within a predetermined range. A compression spring 46 (a compression coil spring in this embodiment) is interposed between the rear portion of the engaging member 45 and the rear end of the pusher 31, so that the engaging member 45 is biased in the fastener feeding direction relative to the pusher 31. The biasing force of the compression spring 46 is set to be smaller than the biasing force of the compression spring 24 that biases the pusher 31 in the fastener feeding direction. A flat plate-like engaging portion 45*a* is formed on the lateral side of the engaging member 45 and corresponds to the engaging portion 54*a* of the known art shown in FIGS. 13 and 14.

The stopper member 47 and extends downward from the operation member 5*a* as shown in FIG. 12. The lower portion of the stopper member 47 protrudes in to the magazine body 21 and is vertically movably supported by the magazine body 21. In addition, the lower portion of the stopper member 47 extends across the moving path of the pusher 31 and is positioned on the front side with respect to the moving path of the engaging portion 45*a* of the engaging member 45. An engaging portion 47*a* configured as an engaging recess is provided on the lower portion of the stopper member 47 and corresponds to the engaging portion 52*a* of the known art shown in FIGS. 13 and 14.

The operation member 5*a* is biased downward by a compression spring 48 (a compression coil spring in this embodiment) toward an off position indicated by chain lines in FIG. 12. In order to perform the driving operation, the operator grasps handle section 5 and pulls the operation member 5*a* upward in FIG. 12 with his or her fingers to turn on the operation member 5*a*, so that the motor 3*a* is started. After completion of the driving operation, the operator may release his or her fingers from the operation member 5*a*, so that the operation member 5*a* returns to an off position by the biasing force of the compression spring 48. As the operation member 5*a* moves between the off position and the on position, the stopper member 47 moves upward and downward together with the operation member 5*a*. Thus, the stopper member 47 moves upward when the operation member 5*a* moves toward the on position against the biasing force of the compression spring 48, while the stopper member 47 moves downward when the operation member 5*a* moves toward the off position by the biasing force of the compression spring 48. In order to ensure a good operability of the operation member 5*a*, the spring force of the compression spring 48 is set to be small but enough to return the operation member 5*a* with the stopper member 47 from the on position to the off position.

According to the representative idle driving operation preventing device 40, as the driver 9 returns upward after the driving operation of the rearmost or last nail no of the stick nail N by the pulling operation of the operation member 5*a*, the pusher 31 moves to the idle driving preventing position where the front end of the pusher 31 protrudes into the fastener driving channel 8. Then, the engaging portion 45*a* of the engaging member 45 abuts to or is pressed against the rear side of the stopper member 47 as shown in FIG. 12. The abutting force or the pressing force of the engaging portion 45*a* is produced by the biasing force of the compression spring 46. The biasing force of the compression spring 24 that biases the pusher 31 is not directly applied to the stopper member 47.

As the operator releases the operation member 5*a* after the driving operation of the last nail ne, the operation member 5*a* with the stopper member 47 moves downward by the biasing force of the compression spring 48. When the twitch lever 47 has reached the off position indicated by chain lines in FIG. 12, the engaging portion 45*a* on the side of the pusher 41 moves to enter or engages the engaging portion 47*a* of the stopper member 47, so that the operation member 5*a* as well as the stopper member 47 may be prevented from moving upward to the on position. Therefore, the operation of the operation member 5*a* for actuating the driver 9 can be prevented, and eventually, the idle driving operation can be prevented.

In order to release the condition where the idle driving operation is prevented, the operator may open the slide door 22, so that the biasing force of the compression spring 24 is released and the pusher 31 is moved rearward.

As described above, according to the representative idle driving operation preventing device 40, the engaging portion 45*a* of the pusher 31 is pressed against the stopper member 47 by a biasing force smaller than that required in the known device. Therefore, the resistance applied to the stopper member 47 against the vertical movement is small. For this reason, as the operator releases the operation member 5*a*, the stopper member 47 smoothly returns from the on position to the off position (indicated by chain lines in FIG. 12) by the biasing force of the compression spring 38. Therefore, the engaging portion 45*a* can reliably engage the engaging portion 47*a* of the stopper member 47. As a result, the idle driving preventing device 40 can reliably operate to perform its function.

The above embodiment may be modified in various ways. For example, although a compression coil spring is used as the compression spring 46 for biasing the engaging member 45 in the above embodiment, the compression spring 46 may be a leaf spring or may be replaced by any other resilient member or biasing device, such as a damper.

Further, although the engaging portion 45*a* on the side of the pusher 31 engages the engaging portion 47*a* of the stopper member 47 when all the nails has been discharged from the fastener storing region 21*a*, it is possible to configure such that the engaging portion 45*a* engages the engaging portion 47*a* of the stopper member 47 when the number of the nails within the fastener storing region 21*a* has reduced to a predetermined number. The predetermined number of the remaining nails may be set, for example, by suitably determining the positional relation between the engaging portion 45*a* and the engaging portion 47*a*. This modification is particularly advantageous in order to enable a reliable feeding operation of nails and a reliable driving operation of the nails in the case that a driving tool is that known as a pin nailer used for driving very thin nails.

Furthermore, although the representative idle driving preventing device has been described in connection with the pin tacker having the electric motor 3*a* as a drive Source (known as power tacker), the idle driving preventing device may be applied to a pneumatic fastener driving device, such as a pneumatic nailer.

The invention claims:

1. An idle driving operation preventing device in a fastener driving tool, the fastener driving tool comprising:

a tool body defining a fastener driving channel and having a driver for driving fasteners supplied into the fastener driving channel, so that the fasteners are driven into a workpiece by the driver, the fasteners being arranged in parallel with each other and joined together;

an operation member mounted to the tool body and operable to move from a first position to a second position in order to actuate the driver;

a magazine arranged and constructed to store the fasteners;

a pusher disposed within the magazine and movable in a fastener feeding direction;

wherein the pusher is biased in the fastener feeding direction by a first spring, so that the fasteners are supplied into the fastener driving channel one after another by a first biasing force applied by the first spring via the pusher;

the idle driving operation preventing device being operable to prevent the driving operation of the driver when all the fasteners within the magazine have been driven or when the number of the fasteners within the magazine has been reduced to a predetermined number, and the idle driving operation preventing device comprising;

an engaging member disposed on the pusher;

a second spring arranged and constructed to apply a second biasing force to the engaging member in the fastener feeding direction;

wherein the second biasing force is smaller than the first biasing force; and a stopper member mounted to the operation member and movable to enter a moving path in the fastener feeding direction of the pusher, so that the engaging member can engage the stopper member in order to inhibit the movement of the operation member from the first position to the second position when all the fasteners within the magazine have been driven or when the number of the fasteners within the magazine has been reduced to a predetermined number.

2. The idle driving operation preventing device as in claim 1, wherein the engaging member is supported on the pusher, so that the engaging member can move relative to the pusher in the fastener feeding direction and a direction opposite to the fastener feeding direction.

3. The idle driving operation preventing device as in claim 1, wherein the stopper member moves in a direction substantially perpendicular to the fastener feeding direction as the operation member moves from the first position to the second position.

4. The idle driving operation preventing device as in claim 3, wherein the operation member is biased in a direction toward the first position.

5. The idle driving operation preventing device as in claim 1, wherein the fastener driving tool further comprises a slide door slidably movably mounted to the magazine in the fastener feeding direction and a direction opposite to the fastener feeding direction in order to open and close the magazine, and wherein the first spring is interposed between the slide door and the pusher.

6. The fastener driving tool as in claim 1, wherein the fastener driving tool further comprises a guide member disposed within the magazine and selectively operable to hold the fasteners against an inner wall of the magazine or to restrict the movement of the fasteners in a direction parallel to longitudinal axes of the fasteners in response to the length of the fasteners stored within the magazine.

7. A fastener driving tool comprising:

a tool body including a fastener driving device operable to drive fasteners, the fasteners being arranged in parallel with each other and joined together;

a magazine arranged and constructed to store the fasteners and including a fastener feeding device operable to feed the fasteners to the fastener driving device;

an operation member operable to actuate the fastener driving device;

a first movable member movable relative to the magazine in response to the number of the fasteners remaining within the magazine;

a second movable member movable relative to the first movable member and engageable with the operation member for preventing the actuation of the fastener driving device when the number of the fasteners remaining within the magazine has been reduced to zero or a predetermined number; and a biasing device interposed between the first movable member and the second movable member and biasing the second movable member in a direction for engagement with the operation member, wherein the fastener feeding device comprises a pusher, and the first movable member comprises a part of the pusher; and wherein the pusher is forced in the fastener feeding direction by a first spring, and the biasing device is a second spring.

8. The fastener driving tool as in claim 7, wherein the biasing force applied to the second movable member by the second spring is smaller than the biasing force applied to pusher by the first spring.

9. The fastener driving tool as in claim 7, further comprising a slide door slidably movably mounted to the magazine in the fastener feeding direction and a direction opposite to the fastener feeding direction in order to open and close tee magazine, and wherein the first spring is interposed between the slide door and the pusher.

* * * * *